US007025942B2

(12) United States Patent
Deschenes et al.

(10) Patent No.: US 7,025,942 B2
(45) Date of Patent: Apr. 11, 2006

(54) CONTROL OF LEAD NITRATE ADDITION IN GOLD RECOVERY

(75) Inventors: Guy Deschenes, Gatineau (CA); Michael Fulton, Carleton Place (CA)

(73) Assignee: Her Majesty the Queen in right of Canada, as represented by the Minister of Natural Resources, Ottawa (CA)

( * ) Notice: Subject to any disclaimer, the term of this patent is extended or adjusted under 35 U.S.C. 154(b) by 252 days.

(21) Appl. No.: 10/094,983

(22) Filed: Mar. 12, 2002

(65) Prior Publication Data

US 2002/0182133 A1 Dec. 5, 2002

(30) Foreign Application Priority Data

Mar. 13, 2001 (CA) ..... 2340606
Jan. 16, 2002 (CA) ..... 2367651

(51) Int. Cl.
*C22B 11/00* (2006.01)

(52) U.S. Cl. ..... 423/29; 75/744

(58) Field of Classification Search ..... 423/29; 75/744

See application file for complete search history.

(56) References Cited

U.S. PATENT DOCUMENTS

| | | | | |
|---|---|---|---|---|
| 5,250,272 | A | 10/1993 | Knorre et al. | |
| 5,275,791 | A | 1/1994 | Knorre et al. | |
| 5,336,474 | A | 8/1994 | Diehl et al. | |
| 5,667,557 | A | 9/1997 | Fleming et al. | |
| 5,961,833 | A * | 10/1999 | Green et al. | 210/638 |

FOREIGN PATENT DOCUMENTS

| | | |
|---|---|---|
| CA | 1107076 | 8/1981 |
| CA | 1172856 | 8/1984 |
| CA | 1245057 | 11/1988 |
| CA | 1262050 | 10/1989 |

OTHER PUBLICATIONS

G. Deschenes and P.J.H Prud'homme, "Cyanidation of a copper-gold ore"., International Journal of Mineral Processing 50:127-141, 1997, no month.

G. Deschenes, M. Rousseau, J. Tardif and P.J.H Prud'homme, Effect of the Composition of Some Sulphide Minerals on Cyanidation and Use of Lead Nitrate and Oxygen to Alleviate their Impact; Hydrometallurgy; 50 205-221, 1998, no month.

G. Deschenes, R. Lastra, J. Brown, S. Jin, O. May and E. Ghali, "Effect of Lead Nitrate on Cyanidation of Gold Ores: Progress on the Study of the Mechanisms", Minerals Engineering, vol. 13, No. 12, pp. 1263-1279, 2000, no month.

S. Healey, G. Deschenes, P. Jean and M. Fulton, "Latest Improvements to the leaching circuit at New Britannia Mine", Randol Gold and Silver Forum 2000, no month.

J. Fulcher and K. Kim, "Reducing Power as The Circuit Chemistry Monitor at Echo Bay mines Limited, Lupin Gold Operation". Proceedings of the International Symposium on Gold Metallurgy, Winnipeg, Canada 1987. vol. 1 Proceedings of The Metallurgical Society of The Canadian Institute of mining and metallurgy, edited by Salter et al. Canada, 1987.

Dufresne "Control of cyanidation at Yvan Vézina plant"; Minerals Engineering, Great Britain Jul. 19, 1994, 7:11: 1427-1434.

(Continued)

*Primary Examiner*—Steven Bos
(74) *Attorney, Agent, or Firm*—Shapiro Cohen

(57) ABSTRACT

A method for controlling the extraction of gold from a gold ore by the cyanidation process in which a leaching step including the addition of a lead compound, which is typically lead nitrate or other lead salt, is used. In order to maintain stable conditions in the leaching process, and to use the leaching reagents efficiently, an analysis step is used to monitor the concentration of thiocyanate in the cyanidation step. This value has been found to be directly related to the rate of addition of the lead compound in the pre-leaching or leaching step. Further, the rate of addition of lead compound is also directly related to both the time required for, and the efficiency of, the cyanidation step. By establishing a target value, and a preferred range, for the thiocyanate concentration based on the properties of the ore being processed, optimal extraction conditions can be established in the leaching process and maintained by monitoring the thiocyanate concentration. By the use of an automated potassium permanganate titration procedure as the analysis step, the thiocyanate concentration can be measured on line with only a short delay.

10 Claims, 3 Drawing Sheets

OTHER PUBLICATIONS

Deschênes "Effect of oxygen and lead nitrate on the cyanidation of a sulphide bearing gold ore"; Minerals Engineering, Great Britain Apr. 5, 1995, 8:8:923.
Kondos "Process optimization studies in gold cyanidation, Hydrometallurgy"; The Netherlands, Jun. 8, 1995, 39:235-250.
Deschênes "Reactions of gold and sulphide minerals in cyanide media"; Minerals & Metallurgical Processing Journal, USA, Jun. 2002, 19:4; 169-177.
Deschênes "Improving cyanidation of a sulphide ore by Pre-leaching with Lead Nitrate"; Int. Symp. Recover of Gold, Canada, CMP/CIM, 2002, 63-70.
Jin, "Electrochemical study of the mechanism of the accelerating effect of lead nitrate on gold cyanidation"; Int. Symp. Recovery of Gold, Canada CMP/CIM, 2002, 87-92.
Jin, "Investigation on the mechanism of the catalytical effect of lead salts on gold dissolution in cyanide solution"; ICHM'98, Kunming, China, Nov. 3-5, 1998.
Deschênes "Assessment and control of the gold leaching parameters at Kiena Mines" MetSoc/ CIM, 38th Ann. Conf. Metallurgist; Quebec City, Canada Aug. 22-26, 1999; 469-487.
Deschênes "Advances in reagent usage in the cyanidation of gold"; MetSoc/ CIM, 41st Ann. Conf. Metallurgist; Montreal, Canada, Aug. 2002.
Deschênes "Improvement of cyanidation at New Britannia Mine";USA; Randol International Ltd., USA, 1999, 149-154.
Deschênes "Effect of the mineralogy of sulphide-bearing gold ores on the performance of cyanidation and its control variables"; Ann. mtg. Cdn. Min. Proc., Canada; 2000, 301-30.
Deschênes "Cyanidation of a Pyrrhotite-Bearing Gold Ore from Musselwhite Mine"; Ann. Mtg. Cdn. Min. Proc., Canada, Jan., 2002, 735-755.

* cited by examiner

Potential (mV)
1200
1100
1000
900
800
700
600
500
0
1
2
3
4
5
6
7
KMnO4 (mL)

Potential (mV)
1200
1000
800
600
400
200
0
0
2
4
6
8
10
12
14
16
18
20
KMnO4 (mL)

[CNS] (ppm)
600
500
400
300
200
100
0
0
6
12
18
24
Time (h)
Pb(NO3)2
0 g/t
100 g/t
200 g/t
300 g/t
500 g/t Au Extraction (%)
90
80
70
60
50
40
30
20
10
0
0
2
4
6
8
10
12
14
Time (h)
Pb(NO3)2
(g/t)
500
300
200
100
50
0

CNS (ppm) - Reducing Power
NaCN (kg/t)
Pb(NO3)2 (g/t)
Reducing Power - Potentiometric
Reducing Power - Visual
NaCN consumed
CNS
150
100
50
0
0.50
0.40
0.30
0.20
0.10
0.00
0
50
100
150

CNS (ppm) - Reducing Power
Pb(NO3)2 (g/t)
Potentiometric
Manual
CNS
1000
900
800
700
600
500
400
100
200
300
400
500

CONTROL OF LEAD NITRATE ADDITION IN GOLD RECOVERY

FIELD OF INVENTION

This invention relates to a method of controlling the rate of addition of lead nitrate to the gold ore leaching process using cyanide, both to improve gold recovery, to achieve more efficient use of the reagents added to the leach solution, and to provide a more stable leaching system.

In current mining practise for gold, the ore normally contains a relatively small amount of gold; a typical crushed ore will contain from about 2 g/t to about 10 g/t. In order to recover the gold from the ore, it is comminuted to a fine powder, and then converted into a thick aqueous pulp, usually containing about 55% solids. The gold is recovered from the ore in the pulp by the cyanidation process, in which sodium cyanide is used to extract the gold from the pulped ore. The gold is extracted from the ore as aurocyanide ions, as a result of the following reaction.

$$4Au+8CN^-+O_2+2H_2O \rightarrow 4Au(CN)_2^-+4OH^-$$

This reaction requires the presence of oxygen, which is ensured by aerating the pulp. The gold bearing leachate is then processed to recover the dissolved gold.

Although the reaction between gold and dissolved sodium cyanide is not complex, the chemistry of the leaching process is complicated by the presence of other species in the ore which react with cyanide ions, or which are soluble under the leaching conditions. These include other metals such as iron (both ferrous and ferric), copper, zinc and arsenic which are often present in the ore as a sulphide, and dissolved sulphur containing species, such as sulphide $S^-$ ions. All of these reactive species, both solid and in solution, compete with the gold for cyanide and hence the cyanide consumption can bear little relationship to the actual gold content of the ore being leached.

In order to decrease the influence of the competing reactive species, the pulp can be given a pre-leach before the leaching is initiated. In a pre-leach at least some of the competing reactive species can be oxidised to a non-competing species; for example, ferrous sulphide can be oxidised to ferrous sulphate, and then converted to ferric hydroxide. A lead compound, which is typically lead nitrate, is added to the system to promote these reactions. For simplicity, the following discussion focusses on the use of lead nitrate; it is to be understood that other lead compounds, such as lead oxide, lead sulphide or lead acetate, can also be used in appropriate quantities.

Although the addition of lead nitrate to the pulp either in a pre-leach step, before the sodium cyanide is added to the pulp, or directly to the leaching step is effective, the difficulty which then arises is that there is no known test procedure which will allow correlation of the amount of lead nitrate and the efficiency of the gold extraction process. This has several results, including inefficient use of reagents, an increase in the toxic waste requiring treatment before disposal, random variation of the gold level remaining in the leach tailings, and overall unstable leach stage operation.

The only known test used to provide at least some indication as to whether the rate of lead nitrate addition should be changed is the so-called "Prussian Blue Test". In this test, a compound alleged to be $Fe_4[Fe(CN)_6]_3$, which has an intense blue colour, is formed. The level of blue colouration formed is directly related to the ferrous ion ($Fe^{++}$) concentration, and is assessed visually. This test is therefore not quantitative. Although this test has been shown to be unaffected by the presence of sodium cyanide at the concentration to be expected in a leach solution, it has been found to be unreliable in the presence of several ionic species commonly occurring in gold leach solutions, including at least thiocyanate, thiosulphate, and copper cyanide.

This invention seeks to overcome at least some of the difficulties in determining an appropriate lead nitrate dosage by providing a relatively simple test. The measurements derived from this test can then be used to control the rate at which lead nitrate is added to the system. The measurements can be obtained on a real time basis, and can be carried out manually or with an automated titration system.

This invention is based on the discovery that there is an empirical correlation between the rate at which lead nitrate is added, the amount of thiocyanate ion ($CNS^-$) in the leach solution, and the overall efficiency of the leaching process, as reflected by the gold content of the ore tailings. For a given ore feedstock, it is possible to establish what may be termed "ideal" leaching conditions for that ore which provide an acceptable leaching rate, and an acceptable leaching efficiency. Investigation has shown that these conditions will include a measurable concentration of thiocyanate ion in the leach solution, and that the measured concentration is empirically linked to both the rate at which lead nitrate is added, and the efficiency of the gold extraction process. As will be explained in more detail below, the thiocyanate concentration can be measured in several ways; there appears to be a significant level of correlation between at least some of the available methods.

It then follows that by establishing "ideal" leach conditions with a known thiocyanate concentration, maintaining that concentration more or less constant will provide more stable leaching conditions and thereby enhance process efficiency. In an ideal situation, the thiocyanate concentration should be maintained constant, but in practise this is not possible, at least in part because the feed ore contains varying amounts of competing reactive species, such as the sulphides of several metals. In practise, this invention makes it possible to set a target for the thiocyanate concentration, within a working range extending both above and below the target concentration. If the thiocyanate concentration falls below the target, then the rate of lead nitrate addition should be decreased; if the thiocyanate concentration rises above the target, then the rate of lead nitrate addition should be increased.

Thus in its broadest embodiment this invention seeks to provide a method for controlling the rate of lead compound addition to a gold cyanidation leach process which comprises:

(a) determining a target value for the concentration of thiocyanate ion ($CNS^-$) in the leach liquor;

(b) determining an acceptable range for the concentration of thiocyanate ion having a first range limit above the target value and a second range limit below the target value;

(c) measuring the concentration of thiocyanate ion in the leach liquor at a known time;

(d) measuring the rate of lead compound addition at the same known time;

(e) comparing the concentration measured in step (c) with the target value, and with the first and second range limits determined in steps (a) and (b); and (f) adjusting the rate of lead compound addition to bring the thiocyanate ion concentration within the range determined in step (b).

Preferably, the lead compound added to the process is chosen from the group consisting of lead nitrate, lead oxide, lead sulphide and lead acetate. More preferably, the lead compound is lead nitrate.

Preferably, the concentration of thiocyanate ion is measured in step (c) by a titration procedure or by a calorimetric procedure. More preferably, the concentration of thiocyanate ion is determined by titrating an aliquot of the leach solution adjusted to have a hydrogen ion ($H^+$) concentration of about 1 M/L by the addition of an acid to a permanent pink endpoint, or to a potentiometric end point at about 850 mV, with potassium permanganate solution, and calculating the concentration of thiocyanate ion by assuming that thiocyanate is the only oxidised species. Alternatively, the concentration of thiocyanate ion is determined calorimetrically, by measuring the absorbance of a test solution at 460 nm. In a further alternative, the concentration of thiocyanate ion is determined under ion-specific conditions using a gradient elution HPLC method.

Preferably, when the concentration of thiocyanate ion is measured titrimetrically in step (c), the titration is carried out with 0.02M potassium permanganate solution, and the acid used to adjust the hydrogen ion concentration for the titration is 25% sulphuric acid.

Preferably, in step (f) the rate of lead compound addition is adjusted to bring the thiocyanate ion concentration close to the target value determined in step (a).

This invention thus provides a relatively simple tool for assessing whether, or not, the rate of lead compound addition, typically lead nitrate, is reasonable. It is also possible to monitor the effectiveness of any changes made in the rate of lead compound addition by monitoring the cyanide consumption in the leach process, and the gold content in the tailings. If the rate of addition of the lead compound is correctly set, then both the cyanide consumption and tailings gold content should decrease.

The invention will now be described with reference to the attached drawings in which.

Figure 1:
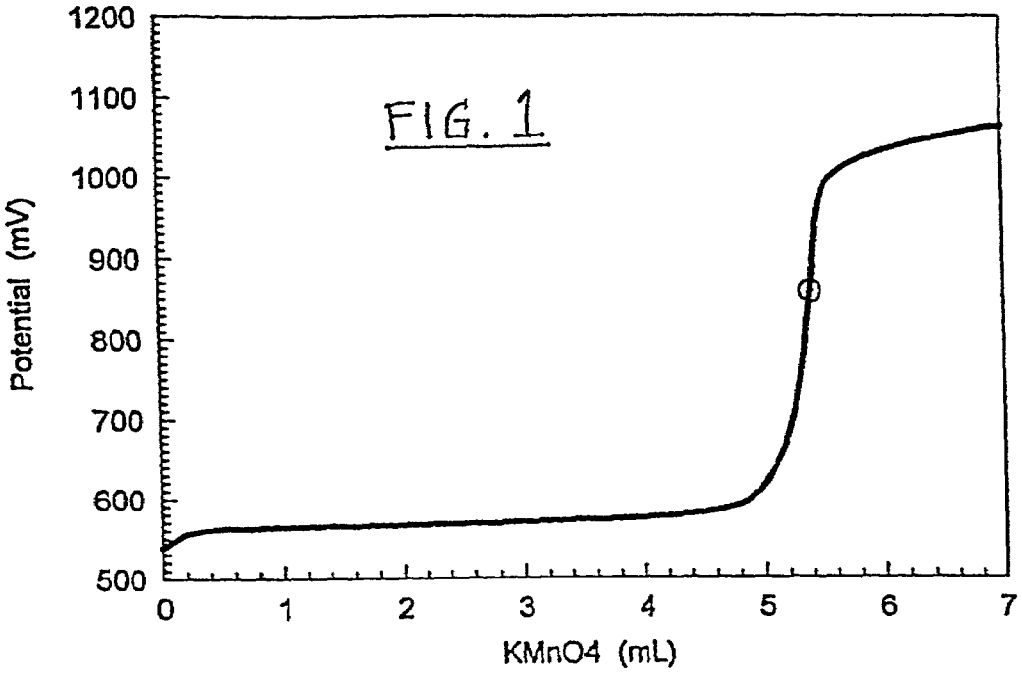
FIG. 1 shows a potentiometric titration curve for thiocyanate ion in the presence of cyanide ion.

To obtain the results discussed below, four analysis procedures were used.

(A) Potentiometric Titration with Potassium Permanganate.

The potassium permanganate solution used was nominally 0.020M, and prepared from reagent grade materials. It was standardised with disodium oxalate using the following procedure. After drying at 120° C. and cooling in a dessicator, a known weight of from about 0.15 g to 0.30 g of disodium oxalate is dissolved with stirring in 200 mL water at about 85° C. on a hot plate, and when dissolved 20 mL of 25% sulphuric acid is added. The indicator electrode is inserted, and the solution titrated immediately while still hot. The molarity of the permanganate solution is calculated from the titration result based on the weight of disodium oxalate taken initially. A Brinkman Metrohm Model 716 DMS Titrino unit was used for all of these titrations, together with Brinkman Torino Worcell Software, Version 4.2 for control and measurement. The end point is determined by the software as the maximum slope for the curve relating the platinum electrode response to the volume of reagent added. The same unit was also used for the thiocyanate titrations described below. In these titrations, the usual sample used was 25 mL of the leach liquid. If acidification is carried out using 25% sulphuric acid, it was found that 25 mL of acid was generally sufficient.

(B) Manual Titration with Potassium Permanganate.

For visual titrations, most of the procedure as in (A) above was used, and the titration was taken to a more or less permanent pink colour.

(C) Colorimetric Analysis.

A volume of sample containing up to about 1 mg of thiocyanate was diluted to 30 ml with water. The pH was adjusted to pH 2 with concentrated nitric acid, and the solution boiled for 1–2 minutes. After cooling, the solution was transferred to a 50 ml volumetric flask, diluted with 2.5 ml ferric nitrate solution, and made up to 50 ml with water. The ferric nitrate solution is prepared by dissolving 404 g of $Fe(NO_3)_3.9H_2O$ in 800 ml water, adding 80 ml of concentrated nitric acid, and diluting to 1000 ml. A sample of the test solution is transferred to an absorption cell, and the absorption measured with a suitable spectrophotometer at 460 nm. The thiocyanate concentration is calculated from a calibration curve obtained using a potassium thiocyanate stock solution. For the calibration curve, the measurements are taken on samples from 50 ml aliquots containing known amounts of the potassium thiocyanate stock solution diluted with a suitable amount of water and 2.5 ml of the ferric nitrate solution. A blank solution was made omitting the potassium thiocyanate stock solution.

(D) Gradient Elution HPLC.

The apparatus used was a DIONEX AS 11 (Trademark) column, together with appropriate supporting hardware and software, in which the separator resin used was a polyethylvinylbenzene/divinylbenzene substrate coated with an anion exchange latex; sodium hydroxide-methanol was used for the gradient elution applications. The anions were measured by a conductivity detector, and the peak elution times determined from stock solutions of the relevant sodium or potassium salts. Under the elution conditions used, the ion peak retention times shown in Table 1 were obtained.

TABLE 1

| Anion | Retention Time, minutes |
|---|---|
| Fluoride | 1.6 |
| Chloride | 2.3 |
| Cyanate | 2.6 |
| Nitrite | 2.5 |
| Bromide | 3.7 |
| Nitrate | 3.9 |
| Sulphite | 5.2 |
| Sulphate | 5.5 |
| Phosphate | 7.6 |
| Thiosulphate | 8.4 |
| Thiocyanate | 10.6 |

In order to establish whether titration of thiocyanate with potassium permanganate to a constant end point, either visually to a more or less permanent pink colour, or using the automatic titrator to determine a potentiometric end point, is reliable, the influence of the presence of sodium cyanide needs to be determined. Investigation has shown that at a sodium cyanide concentration of 200 ppm, and at a thiocyanate concentration ranging from 250 ppm to 750 ppm, the titration response is essentially the same, and within reasonable experimental error. Additionally, these tests also showed that the potentiometric and calorimetric end points are in agreement; the calorimetric end point appears to be slightly higher (in terms of added volume of permanganate solution) than the potentiometric one. A typical potentiometric titration curve for 250 ppm thiocyanate in the presence of 200 ppm sodium cyanide is shown in FIG. 1. The potentiometric endpoint is at approximately 850 mV.

Non-oxidation of cyanide under the titration conditions is important, since the objective of the test is to measure thiocyanate; this is the principal reason for using a strongly acid solution. Under alkaline conditions permanganate will oxidise cyanide quantitatively.

Figure 2:
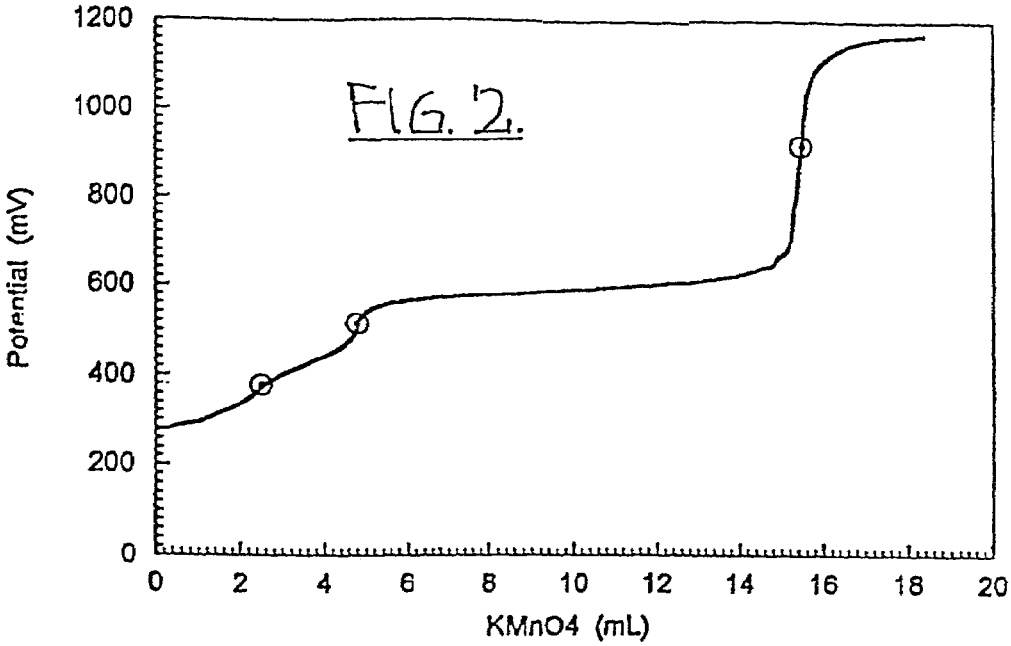
FIG. 2 shows a potentiometric titration curve for a typical leach solution.
Figure 5:
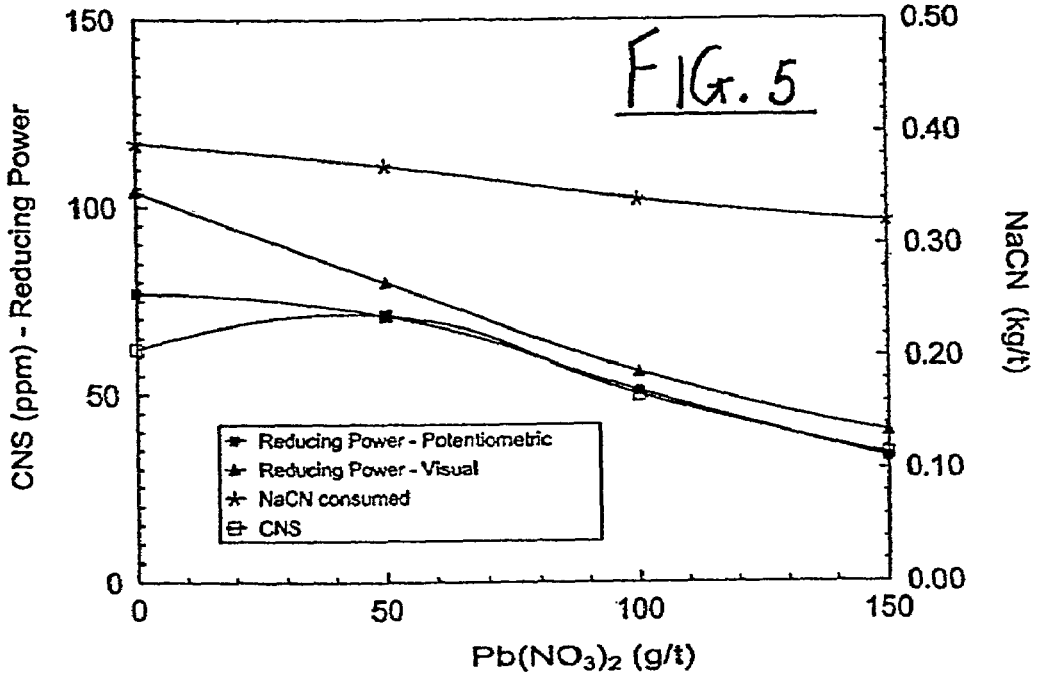
FIG. 5 shows the correlation between titration methods and gradient elution HPLC.
Figure 6:
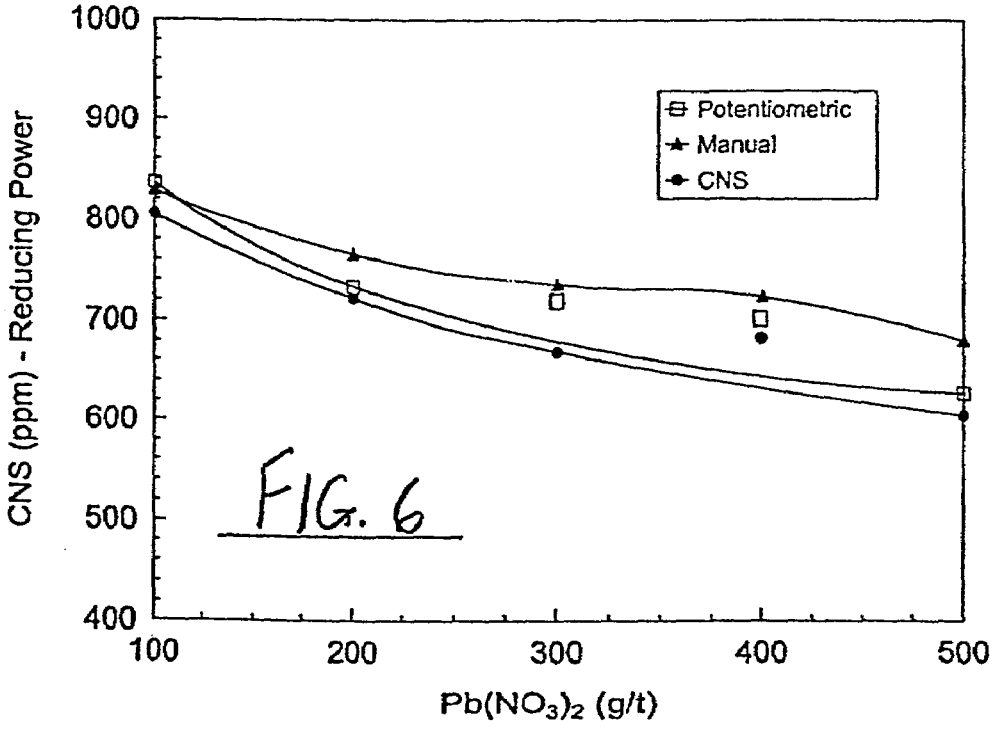
FIG. 6 shows the correlation between potentiometric titration methods and gradient elution HPLC when used to correlate lead nitrate addition to thiocyanate content.

A typical potentiometric titration curve for a leach solution is shown in FIG. 2. The titration was made after 24 hours cyanidation which followed a pre-leach using 100 g/t lead nitrate. This curve shows at least three apparent endpoints, at about 400 mV, about 500 mV and about 850 mV. It is not known with any certainty what oxidation reactions are indicated by the first two end points. The third end point correlates well with the known potentiometric end point for thiocyanate; when observed visually, this corresponds to a rapidly fading pink colouration. A persistent pink colour is not obtained until somewhat after the third end point. It is this endpoint which is used in this invention to determine the thiocyanate concentration. The thiocyanate concentration is then calculated from the titration volume required to reach this endpoint, it being assumed that thiocyanate is the only reactive species. The two inflexion points in FIG. 2 indicate that there are at least two other reactive species, which do not appear to interfere with the use of the thiocyanate concentration measured as a reliable process control parameter. As is shown in FIGS. 5 and 6, there arrears to be good correlation between potentiometric titration, visual titration, and gradient elution HPLC. In FIGS. 5 and 6 the traces are as follows:

Reducing Power—Potentiometric: titration, potentiometric;

Reducing Power—Visual: titration, visual endpoint; and

CNS: ion-specific thiocyanate measurements using HPLC.

The results shown in FIGS. 5 and 6 are of the relationship between lead nitrate addition and thiocyanate content during leaching of two typical different gold mine ores. The leach solutions contained 230 ppm sodium cyanide in FIG. 5, and 450 ppm sodium cyanide in FIG. 6. It can thus be seen that there is reasonable correlation between the ion-specific measurements and the ion-nonspecific measurements. It is thus apparent that although there is a difference in the value obtained for the thiocyanate concentration depending on the analytical method used, the observable trend in the data is the same. Although an ion-specific method such as gradient elution HPLC will be more accurate, it is both slower, more complex, and requires much more expensive and sophisticated equipment than either of the titration methods. The potentiometric titration method also appears to be well adapted to installation in an operating gold leaching plant unit. The calorimetric method appears to be as reliable, and subject to the same errors, as the titration methods.

Thus although the titration methods to an extent will be influenced by other ionic species, for example thiosulphate is probably the cause of the point of inflexion at about 500 mV in the potentiometric titration curve shown in FIG. 2, from a practical standpoint this method is preferred.

Figure 3:
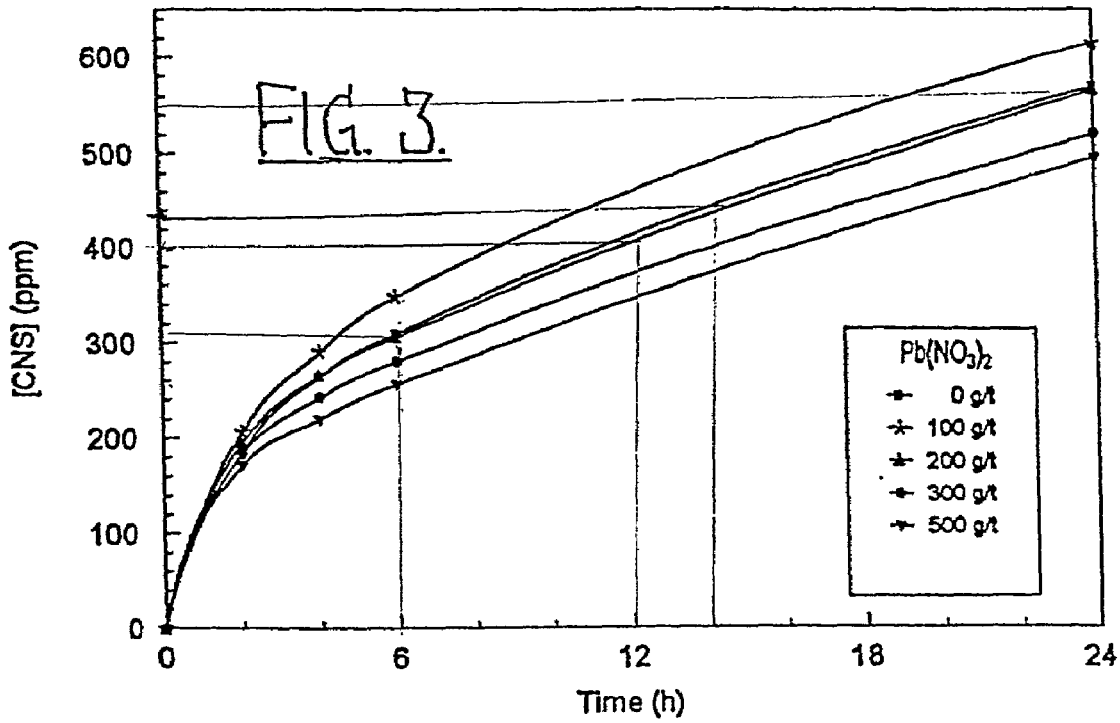
FIG. 3 shows a set of typical leaching curves for a specific gold ore.

The correlation between rate of lead nitrate addition in the pre-leach step with thiocyanate formation during the cyanidation leach process is shown in FIG. 3 for a typical gold ore. The characteristics of this ore are shown in Table 2. In these leach experiments the only variable was the rate of lead nitrate addition; the other leaching condition parameters were kept constant.

TABLE 2

| Chemical Analysis, % by weight | Mineralogical Analysis % by weight |
|---|---|
| Au 2.79 g/t | Major phases: |
| Ag 0.71 g/t | chlinochlore, muscovite and |
| Si 27.37 | calcite: 44.6 |
| Fe 12.07 | quartz, sepiolite and |
| Al 3.9 | albite: 42.7 |
| Ca 3.6 | pyrrhotite: 6.2 |
| S 3.52 | pyrite: 2.1 |
| Mg 1.6 | arsenopyrite: 0.6 |
| As 0.27 | chalcopyrite: 0.1 |
| Cu 0.019 | magnetite: 0.1 |
| Ni 0.007 | sphalerite: 0.1 |
| Zn 0.014 | galena: traces |
| Sb <0.01 | |
| Te <0.002 | |
| Organic Carbon 0.10 | |

The pre-leaching was carried out at pH 10.2 with 12 ppm oxygen for four hours; the cyanidation was carried out at pH 10.2, 12 ppm oxygen and 4.50 ppm sodium cyanide. FIG. 3 shows the effect of different rates of addition of lead nitrate. From FIG. 3 it is clear that as the lead nitrate rate used in the preleach increases, from zero to 500 g/t in 100 g/t steps, in the cyanidation although the measured concentration of thiocyanate increases with time, the concentration decreases as the lead nitrate addition rate increases.

Figure 4:
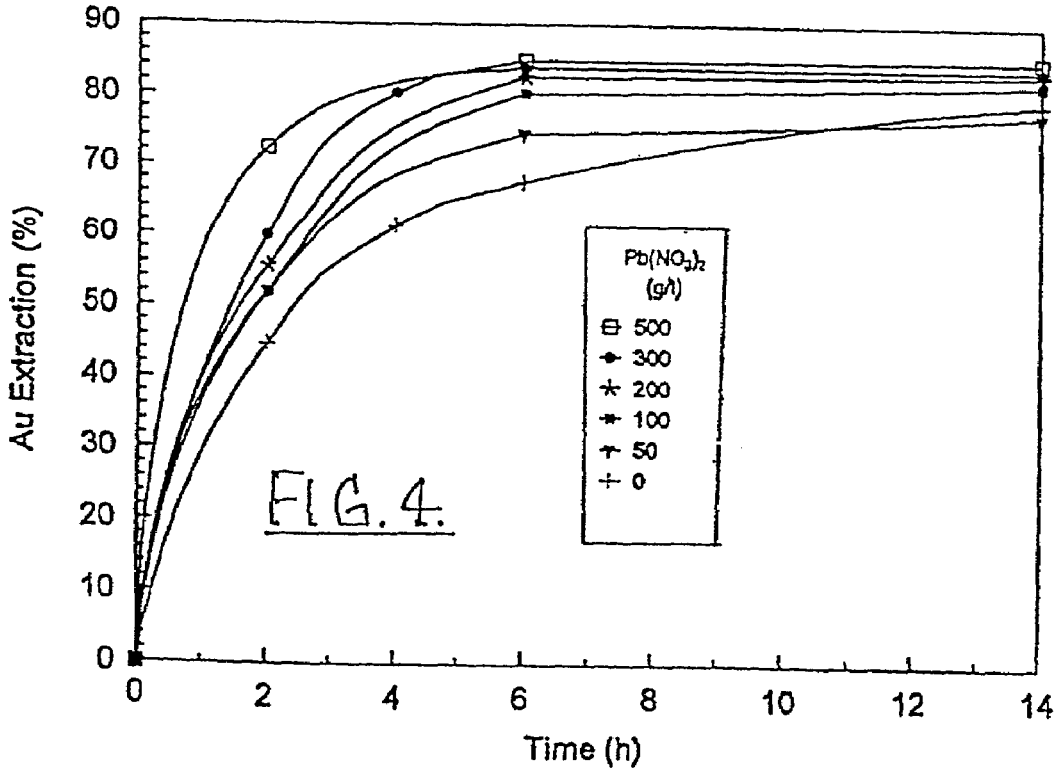
FIG. 4 shows the relationship of lead nitrate addition with thiocyanate concentration for the same gold ore as in FIG. 3.

In order to establish both the target value and the first and second range limits for the thiocyanate concentration, it is necessary to determine an "ideal" set of conditions for the cyanidation leach process. This requires a knowledge of the relationship between the rate of lead nitrate addition in the pre-leach step, and the efficiency of gold extraction in the cyanidation leach process. A family of curves for the same gold ore is shown in FIG. 4. To obtain these results, samples were extracted from the pulp at the indicated times and assayed to determine gold content. The amount extracted is then expressed as a percentage of the original value.

Three features of these curves are noteworthy.

First, the leach rate, and the amount of gold left in the tailings, are both directly related to the rate of addition of lead nitrate in the pre-leach. Second, above 100 g/t lead nitrate the gold left in the tailings does not change very much: the actual values are as shown in Table 3. Third, when leaching after a pre-leach in which lead nitrate is added, the leach process proceeds far more quickly. Without any lead nitrate in the pre-leach, extraction is still continuing at 14 hours; with lead nitrate in the pre-leach at or above 50 g/t the cyanidation leach is more or less complete in 6 hours. It is then noteworthy that in FIG. 3, which was obtained under the same conditions, the plot of thiocyanate concentration becomes more or less linear with time.

TABLE 3

| Lead Nitrate, g/t | Tailings Au g/t |
|---|---|
| 0 | 0.58 (20.7%) |
| 50 | 0.62 (22.2) |
| 100 | 0.50 (17.9%) |
| 200 | 0.47 (16.8%) |
| 300 | 0.45 (16.1%) |
| 500 | 0.41 (14.7%) |

The data in Table 3 and the traces in FIG. 4 suggest that under these conditions a target value for the thiocyanate concentration is about 310 ppm for 6 hours of leaching, about 400 ppm for 12 hours of leaching and about 420 ppm for 14 hours of leaching.

To use the concept of this invention it is thus apparent that essentially three steps are needed. First, the target value and the range limits for the thiocyanate concentration need to be determined for the ore to be treated. No two bodies of ore are the same, and furthermore the ore derived from an ore body is always subject to some variation. Second, the rate of addition of lead compound must be monitored. Third, the thiocyanate concentration in the leach liquor in the cyanidation step must also be measured using the chosen analytical technique, which should not be changed for an extended period of time, in order to provide a basis of analytical data from which desirable leach conditions can be derived and monitored. For these measurements the preferred analysis technique is the potassium permanganate titration described above. If an automatic potentiometric titrator is used, the thiocyanate concentration can be obtained on line at any suitable time frequency, with only a short delay being required to perform the analysis. It then follows that by combining these three sets of data, the conditions in the leaching step of the gold recovery process can be optimised.

What is claimed is:

1. A method for improving the efficiency of a gold cyanidation leach process by controlling and modifying the rate of lead compound addition to a leach liquor, by adjusting the rate of addition according to the concentration of thiocyanate ion in the leach liquor, the method comprising the steps of:

(a) determining a target value for the concentration of thiocyanate ion (CNS) in the leach liquor;

(b) determining an acceptable range for the concentration of thiocyanate ion having a first range limit above the target value and a second range limit below the target value;

(c) measuring the concentration of thiocyanate ion in the leach liquor at a known time;

(d) measuring the rate of lead compound addition at the known time of (c);

(e) comparing the concentration measured in (c) with the target value, and with the first and second range limits determined in (b) for the target value determined in (a);

(f) adjusting the rate of lead compound addition to maintain the thiocyanate ion concentration within the range determined in (b); and (g) monitoring the process by applying (a) to (f) at regular intervals.

2. A method according to claim 1 wherein the lead compound addition is selected from the group consisting of lead nitrate, lead oxide, lead sulphide and lead acetate.

3. A method according to claim 1 wherein the lead compound addition is lead nitrate.

4. A method according to claim 1 wherein the concentration of thiocyanate ion is measured in (c) by an analysis procedure selected from the group consisting of a titration procedure, a colorimetric procedure and a gradient elution HPLC method.

5. A method according to claim 4 wherein the concentration of thiocyanate ion is determined by titrating an aliquot of the leach solution adjusted to have a hydrogen ion ($H^+$) concentration of about 1M/L by the addition of an acid to a permanent pink endpoint, and the thiocyanate concentration is calculated on the assumption that thiocyanate ion is the only titrated species.

6. A method according to claim 4 wherein the concentration of thiocyanate ion is determined by titrating an aliquot of the leach solution adjusted to have a hydrogen ion ($H^+$) concentration of about 1M/L by the addition of an acid to a potentiometric end point at about 850 mV, with potassium permanganate solution, and calculating the concentration of thiocyanate ion by assuming that thiocyanate is the only oxidised species.

7. A method according to claim 4 wherein the concentration of thiocyanate ion is determined calorimetrically, by measuring the absorbance of a test solution at 460 nm.

8. A method according to claim 4 wherein the concentration of thiocyanate ion is determined under ion-specific conditions using a gradient elution HPLC technique.

9. A method according to claim 5 or 6 wherein the acid used to adjust the hydrogen ion concentration for the titration is 25% sulphuric acid.

10. A method according to claim 1 further including the steps of:

(h) monitoring the effectiveness of the adjusted rate of lead compound addition in (f) by monitoring the cyanide consumption in the leach process, and the gold content in tailings of the leach liquor;

(i) monitoring and readjusting at regular intervals the rate of lead compound addition in (f) to maintain the thiocyanate ion concentration within the range determined in (b).

* * * * *